US005350159A

United States Patent [19]

Parker

[11] Patent Number: 5,350,159

[45] Date of Patent: Sep. 27, 1994

[54] ON/OFF VALVE APPARATUS FOR USE IN CONJUNCTION WITH ELECTROMAGNETIC FLOW CONTROL DEVICE CONTROLLING THE FLOW OF LIQUID METAL THROUGH AN ORIFICE

[75] Inventor: Irvin L. Parker, Freehold, N.J.

[73] Assignee: Westinghouse Electric Corporation, Pittsburgh, Pa.

[21] Appl. No.: 19,251

[22] Filed: Feb. 18, 1993

[51] Int. Cl.[5] ..... B22D 41/22

[52] U.S. Cl. ..... 266/237; 222/593; 222/600

[58] Field of Search ..... 266/236, 237; 222/592, 222/593, 597, 600

[56] References Cited

U.S. PATENT DOCUMENTS

| | | | |
|---|---|---|---|
| 4,655,237 | 4/1987 | Gloor et al. | 266/237 |
| 4,842,170 | 6/1989 | Del Vecchio et al. | 266/237 |
| 5,186,886 | 2/1993 | Zerinvary et al. | 266/237 |

*Primary Examiner*—Scott Kastler

[57] ABSTRACT

A valve combination is provided for controlling the flow of liquid metal through an orifice. The valve combination includes an electromagnetic flow control device and an on/off valve. The on/off valve includes an electrically conductive slider plate which is positioned sufficiently close to the electromagnetic flow control device to be inductively heated by the electromagnetic field generated thereby. The on/off valve permits the flow of liquid metal to be selectively stopped and started as desired. The valve combination is suitable for use with open pour and shrouded continuous casting or vessel pouring operations.

20 Claims, 3 Drawing Sheets

ON/OFF VALVE APPARATUS FOR USE IN CONJUNCTION WITH ELECTROMAGNETIC FLOW CONTROL DEVICE CONTROLLING THE FLOW OF LIQUID METAL THROUGH AN ORIFICE

BACKGROUND OF THE INVENTION

1. Field Of The Invention

This invention relates to an apparatus for controlling the flow of liquid metal, and more particularly, to an on/off valve for use with an electromagnetic flow control device.

Electromagnetic flow control devices, or valves (EMVs), have been demonstrated for many industrial applications. For example, it has been found that EMVs are particularly well suited for controlling liquid metal flow in continuous casting lines. U.S. Pat. No. 4,842,170 illustrates how EMVs are typically used in such applications. EMVs may also be used in billet or slab casters. In these types of casters, EMVs may be used to regulate the flow of liquid metal through a nozzle from a tundish to a mold.

EMVs are not suitable for use as shut-off valves for stopping the flowing metal. The liquid metal flowing through the EMV removes excess heat generated by the EMV. Using the EMV to stop the flowing metal could cause the metal to overheat and atomize, which is undesirable in a casting operation.

In existing casting operations, several devices have been used to stop the flow of liquid metal through a nozzle. One device is a chill-plug. A chill-plug is typically a conical-shaped copper plug which is inserted into the lower, or discharge, end of the nozzle. The chill-plug freezes the metal in the nozzle, thereby forming a column of solid metal which stops the flow. Chill-plugs may be used in open pour continuous casting operations where the nozzle is relatively small. Chill-plugs have not been adaptable for use in slab casters. The nozzle of the slab caster often is too large for the chill-plug to freeze a sufficient amount of metal to adequately stop the flow through the nozzle.

In addition, in order for a chill-plug to be used, the discharge end of the nozzle must be accessible, as in open pour operations. Many continuous casting operations today use shrouded flow, whereby a shroud extends from the discharge end of the nozzle to the mold. The shroud forms a conduit for the flowing metal and keeps contaminants from ingesting into the stream of metal. The presence of the shroud makes the lower end of the nozzle inaccessible, thereby making the use of the chill-plug impractical.

After the flow of metal has been stopped, it is usually necessary to restart the flow after some elapsed time. In operations using chill plugs, restart of the stopped flow is accomplished using an oxygen lance. The flame of the oxygen lance is applied to the discharge end of the nozzle to melt the column of frozen metal, thereby allowing metal to begin flowing again. A disadvantage of using an oxygen lance is that it may damage the refractory material from which the nozzle is made. The damage to the nozzle may increase the size of the nozzle orifice. Any variation in the size of the nozzle orifice may change the flow rate of the liquid metal through the nozzle, thereby requiring adjustments to the overall caster flow rate. Such adjustments are typically made by changing the level of the liquid metal in the tundish or may be made using an EMV. In addition, the damage to the nozzle shortens the operational life of the nozzle, which may increase the down time required for maintenance and restart processes.

Another type of device used to stop the flow of liquid metal is a slide gate. A slide gate is mounted on the lower, or discharge, end of the nozzle such that an opening through the slide gate is in communication with the opening through the nozzle. A slide plate may be positioned over the opening through the slide gate to block the flow of metal therethrough. The slide plate may also have a plurality of openings therethrough which allow the metal to flow through the slide plate to maintain and regulate the flow of metal.

A slide gate used to block the flow of metal can only be used to stop metal flow for short periods of time. If freezing of the metal occurs in the slide gate plates, there is no way to restart the flow without disassembling the slide gate. In addition, a slide gate typically uses a cumbersome and complicated actuator mechanism to operate the slide plate. One reason such a mechanism is required is that the slide plate must often be kept in constant vibratory motion to keep the metal adjacent to the slide plate from freezing and thereby preventing actuation of the slide gate. Because of the cumbersome control mechanism, slide gates are relatively large devices which are not well suited for use in smaller nozzle continuous casting operations, particularly those operations which utilize shrouded flow.

Another type of device commonly utilized to stop the flow of liquid metal is a stopper rod. A stopper rod is inserted into the upper end of the nozzle. This type of device can be used with continuous casters which utilize shrouded flow because no access to the lower end of the nozzle is required. However, this type of device requires mechanical linkages above the tundish to position and activate the stopper rod. The linkage and stopper rod require maintenance and their life is relatively short. In addition, the use of a stopper rod may damage the refractory material at the entrance to the nozzle.

A need exists for a compact device that can be utilized with an EMV flow control device to stop and restart the flow of liquid metal through a nozzle without causing damage to the nozzle or requiring complex activator mechanisms to operate. The device should permit flow to be restarred after the metal in the nozzle has frozen. Operating the device should not require access to the lower or discharge end of the flow nozzle so that the device can be utilized with casters which use open pour or shrouded flow processes.

SUMMARY OF THE INVENTION

This invention has met the above-described needs.

For ease of disclosure the terms "upstream" and "downstream" have been used to describe directions relative to the direction of flow of the liquid metal through the device.

This invention provides a valve combination for controlling the flow of liquid metal through an orifice of a nozzle. The valve includes a non-conductive nozzle having an opening therethrough defining the orifice through which the liquid metal flows. The upstream end of the nozzle is in communication with a source of liquid metal, typically a tundish. An electromagnetic flow control device or valve (EMV) is adjacent to and surrounds the nozzle. An on/off valve is connected to the downstream end of the nozzle. The on/off valve has a generally longitudinal opening therethrough which is in communication with the opening through the nozzle. The on/off valve also includes an electrically conductive slider plate having at least one opening therethrough. The slider plate is positioned sufficiently close to the EMV such that it will be inductively heated by the electromagnetic field generated by the EMV.

When the opening in the slider plate is aligned with the opening in the valve, liquid metal may flow therethrough. When the opening in the slider plate is not aligned with the opening through the valve, the flow of metal is blocked. Slide means are provided for moving the slider plate in a plane generally perpendicular to the opening through the valve to selectively align the opening through the slider plate with the opening through the valve.

It is an object of this invention to provide an on/off valve for controlling the flow of liquid metal through a nozzle that can be used with an electromagnetic flow control device.

It is another object of this invention to provide such an on/off valve which can be used to start or stop metal flow without requiring access to the downstream end of the nozzle on which it is used.

It is a further object of this invention to provide such an on/off valve which can be used in a casting operation which utilizes shrouded flow.

It is yet another object of this invention to provide such an on/off valve which may be used with nozzles having openings of various sizes, for example, billet, bloom and slab casters and pouring ladles.

It is another object of this invention to provide such an on/off valve which can be activated using a relatively simple slide mechanism.

It is a further object of this invention to provide such an on/off valve which can be used to stop the metal flow for an extended period without concern for whether the liquid metal freezes within the orifice of the nozzle.

It is another object of this invention to provide such an on/off valve which can be inductively heated by the EMV and thereby melt metal which has frozen within the orifice of the nozzle and thereby restart metal flow.

These and other objects of this invention will be more fully understood from the following detailed description on reference to the appended drawings.

DESCRIPTION OF THE PREFERRED EMBODIMENT

Figure 1:
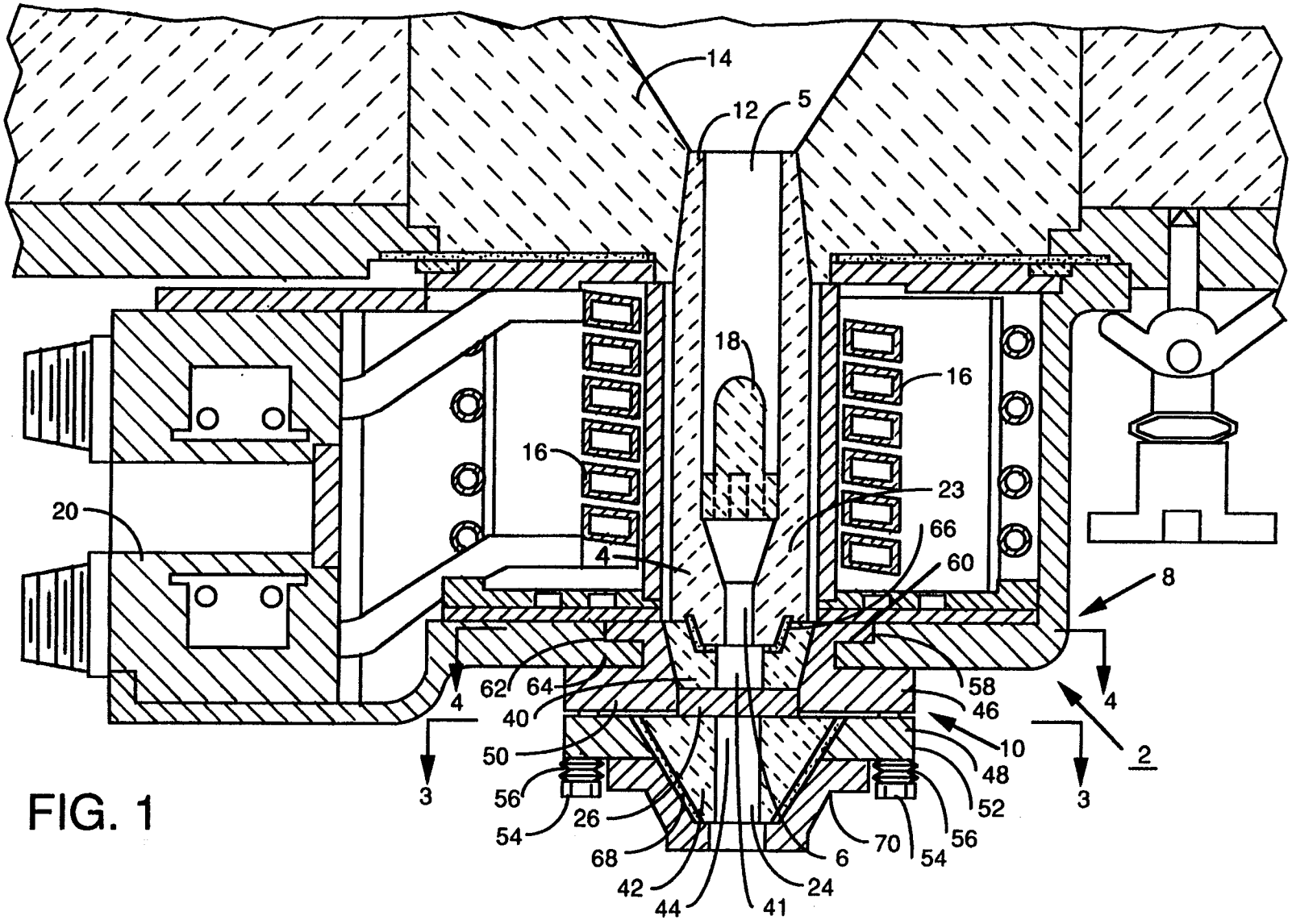
FIG. 1 is a longitudinal sectional view taken through the center line of the invention showing an embodiment of this invention.

Referring to FIG. 1, there is shown an embodiment of the valve combination 2 of this invention as used in a continuous casting operation. Valve combination 2 includes a nozzle 4 having a first generally longitudinal opening 5 therethrough defining a generally cylindrical orifice 6, an electromagnetic flow control device (EMV) 8 and an on/off valve 10. An upstream end 12 of nozzle 4 is in communication with a source of liquid metal, such that the liquid metal may flow through orifice 6. In a preferred embodiment, the source of liquid metal is a tundish 14 and the liquid metal is steel. It will be appreciated, however, that this invention may be used with any suitable liquid metal holding vessel and with any suitable type of liquid metal. Nozzle 4 is preferably constructed of non-conductive material, such as zirconium, for example.

EMV 8 is positioned adjacent to and surrounds nozzle 4. EMV 8 preferably includes an alternating current electric coil 16 adjacent to and surrounding nozzle 4, and a non-conductive structure 18 disposed within and along a portion of coil 16 within nozzle 4. Structure 18 preferably occupies an axial portion of orifice 6 and adjacent portions of orifice 6 are unoccupied. The unoccupied portions of the orifice define flow regions and the occupied regions define non-flow regions. The non-flow regions are preferably positioned generally circumferentially adjacent to the flow regions. A preferred EMV is disclosed in U.S. Pat. No. 4,842,170, the disclosure of which is incorporated herein by reference. It will be appreciated, however, that any suitable EMV may be used.

EMV 8 is used to control the flow of liquid metal through nozzle 4. AC electrical current is supplied to coil 16 through energizing means 20 to generate an electromagnetic field. The electromagnetic field generated by coil 16 may be used to selectively assist or impede the flow of liquid metal through nozzle 4. In a preferred embodiment, coil 16 is disposed inside housing 22, which is mounted on an under side of tundish 14.

Figure 2:
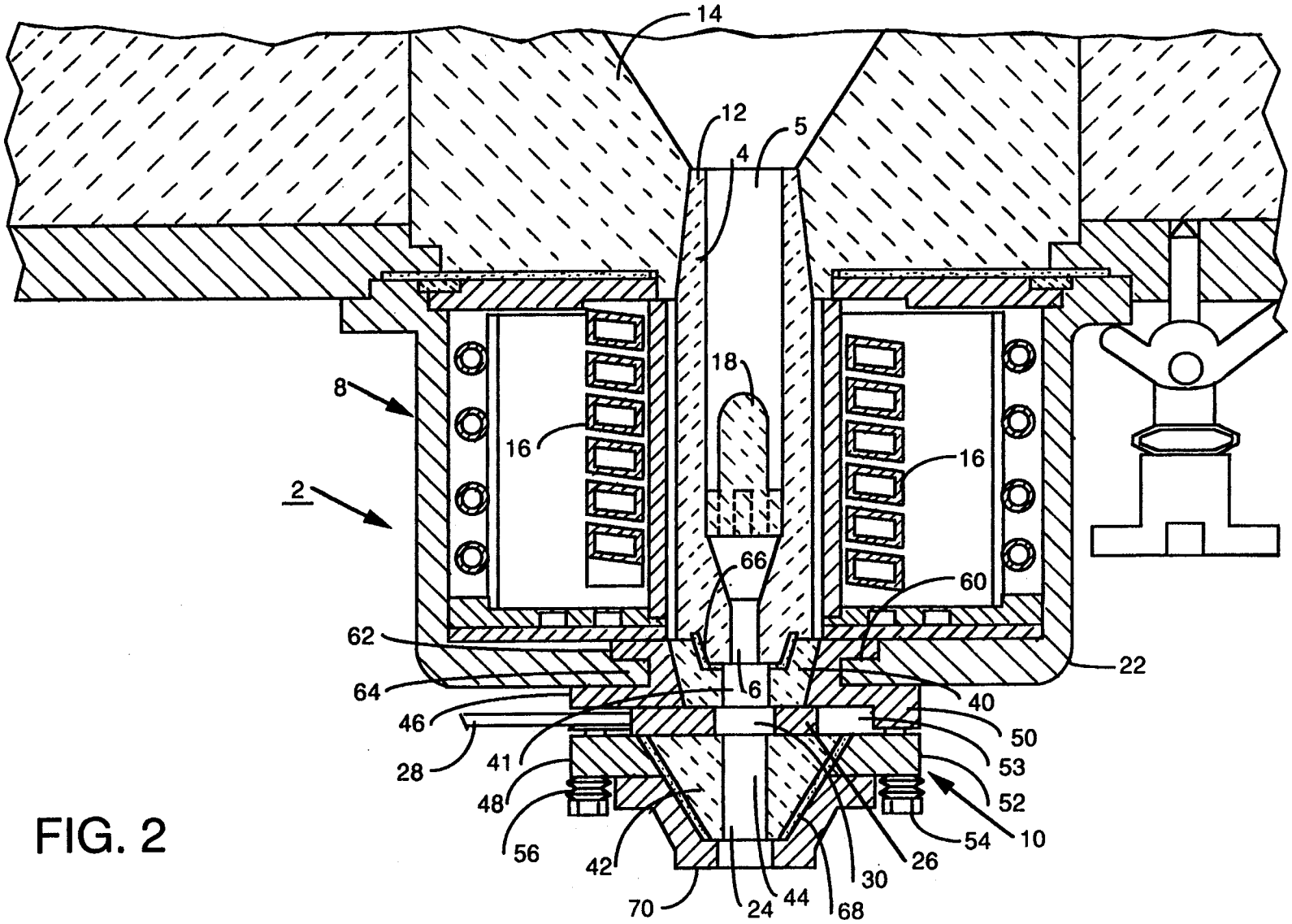
FIG. 2 is a longitudinal sectional view of an embodiment of this invention taken 90° relative to FIG. 1.

Referring to FIGS. 1 and 2, on/off valve 10 is in communication with downstream end 23 of nozzle 4. On/off valve 10 includes a generally longitudinal opening 24 therethrough and an electrically conductive slider plate 26. Opening 24 is in communication with opening 5 in nozzle 4. Slider plate 26 is positioned sufficiently close to EMV 8 so as to be inductively heated by the electromagnetic field generated thereby. In a preferred embodiment, slider plate 26 is made of graphite. Alternatively, slider plate 26 may be coated with graphite. Graphite which has high electrical conductivity and low coefficient of friction.

Figure 3A:
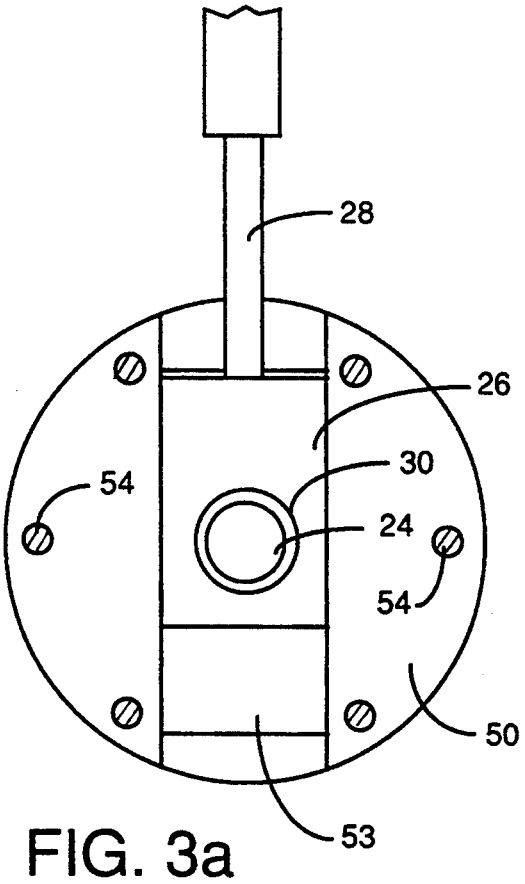
FIG. 3*a* is a cross-sectional view taken through line 3—3 of FIG. 1 showing the slider plate of this invention in an open position.
Figure 3B:
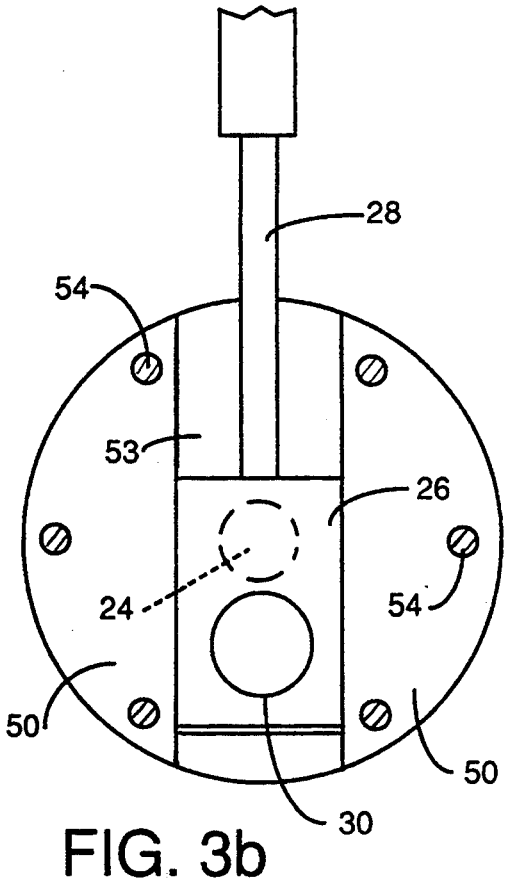
FIG. 3*b* is a cross-sectional view taken through line 3—3 of FIG. 1 showing the slider plate of this invention in the closed position.

Referring now to FIGS. 2, 3*a* and 3*b*, slider plate 26 has a generally cylindrical opening 30 therethrough. Opening 30 may be selectively aligned with opening 24. FIGS. 2 and 3*a* show openings 24 and 30 aligned and FIG. 3*b* shows the openings in the non-aligned position. When openings 24 and 30 are aligned, liquid metal may freely flow through valve combination 2. When openings 24 and 30 are not aligned, the flow of metal is blocked. Opening 24 is preferably slightly smaller than opening 30.

Slide means 28 is provided for moving slider plate 26 in a plane generally perpendicular to opening 24. Slide means 28 may be one or more hydraulic or pneumatic cylinders in communication with slider plate 26. Alternately, any suitable slide means may be used, for example, slider plate 26 may be manually moved if sufficient force can be applied. In a preferred embodiment, hydraulic cylinders are used.

Referring again to FIGS. 1 and 2, in a preferred embodiment on/off valve 10 includes a first non-conductive insert 40 in communication with the downstream end 23 of nozzle 4. Insert 40 has an opening 41 therethrough defining a portion of second generally longitudinal opening 24. The downstream portion of insert 40 is in surface-to-surface communication with an upstream surface of slicer plate 26. Second non-conductive insert 42 is in surface-to-surface contact with the downstream surface of slider plate 26. Second insert 42 has an opening 44 therethrough which defines a portion of second generally longitudinal opening 24. Mounting means 46 are provided to maintain first insert 40 in communication with nozzle 4. Mounting means 46 includes compression means 48 for maintaining first insert 40, slider plate 26 and second insert 42 in surface-to-surface communication. It is desirable to maintain a high amount of compressive force to hold those components together in order to resist the intrusion of liquid metal into the interfaces between the components. Inserts 40 and 42 are preferably made of alumina, a non-conductive refractory material. It will be appreciated however that any suitable non-conductive refractory material may be used.

In a preferred embodiment, compression means 48 includes a locking plate 50 and a collector nozzle 52. Locking plate 50 surrounds and is in communication with first insert 40 and slider plate 26. Locking plate 50 preferably includes a channel 53 in which slider plate 26 is positioned. Channel 53 is preferably substantially equal in width to slider plate 26. Slider plate 26 is shorter in length than the extent of channel 53 such that sufficient movement of slider plate 26 is permitted to align openings 24, 30 and to insure that slider plate 26 completely covers opening 24 when the openings are not aligned. Collector nozzle 52 is in communication with and surrounds second insert 42. A plurality of fastener means 54 for connecting collector nozzle 52 to locking plate 50 are provided. Fastener means 54 preferably include a plurality of conventional threaded bolts (See FIGS. 1–3). Fastening means 54 preferably includes spring means 56 thereon for maintaining compressive force between collector nozzle 52 and locking plates 50 to compressively hold first insert 40, slider plate 26 and second insert 42 in contact with one another and to hold first insert 40 in compressive contact with nozzle 40. Spring means 56 are preferably belleville springs or wave washers which are well known to those skilled in the art. It will be appreciated, however, that any suitable spring means may be used.

In a preferred embodiment, the surface of second insert 42 and the surface of collector nozzle 52 which are in communication with one another are generally tapered, thereby allowing the desired compression force to be maintained. Likewise, the surface of first insert 40 and the surface of locking plate 50 which are in communication with one another are tapered so that the desired compression force is maintained. Locking plate 50 and collector nozzle 52 are preferably made from non-magnetic stainless steel. However, it will be appreciated that any similar non-corrosive, non-magnetic material may be used.

Figure 4:
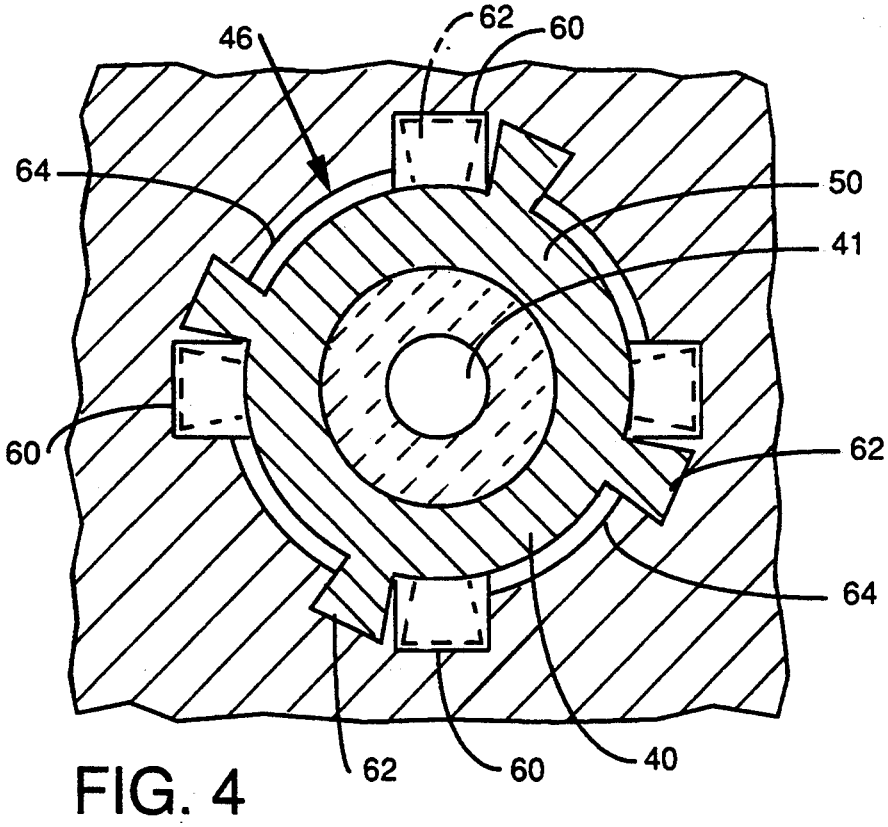
FIG. 4 is a cross-sectional view taken through line 4—4 of FIG. 1.

Referring now to FIGS. 1, 2, and 4, mounting means 46 also preferably includes a bayonet mount having a male portion 58 on locking plate 50 and a female portion 60 on housing 22 of the EMV 8. Male portion 58 is inserted into female portion 60 and on/off valve 10 is rotated about its longitudinal axis about $\frac{1}{8}$ to $\frac{1}{4}$ if a turn. The rotation of valve 10 engages flange 62 of locking plate 50 with flange 64 of housing 22, thereby holding valve 10 in place and contact with nozzle 4. As described above, compression means 48 assists in maintaining first insert 40 in compressive contact with nozzle 4. Removal of valve 10 may be accomplished by rotating the valve in the opposite direction and disengaging male portion 58 from female portion 60. Mounting means 46 preferably facilitates easy installation and removal of on/off valve 10 from housing 22.

Referring again to FIGS. 1 and 2, in a preferred embodiment, gasket means 66 are provided between nozzle 4 and first insert 40. Gasket means 66 resists the intrusion of liquid metal into the interface between nozzle 4 and first insert 40. Second gasket means 68 are preferably provided between second insert 42 and collector nozzle 52 to resist the intrusion of liquid metal into the interface between those components. In a preferred embodiment, gasket means 66 and 68 are made of light weight mortar or equivalent light weight refractory joint sealing compound.

In a preferred embodiment, shroud means 70 is connected to the downstream end of valve 10. Shroud 70 defines a conduit for the liquid metal from the discharge end of valve combination 2 to a casting mold (not shown). A shroud, such as shroud 70, is typically used with shrouded casting operations. Shroud 70 is preferably of a type known to those skilled in the art and is secured to valve 10 in any suitable manner known to those skilled in the art. In the preferred embodiment, gasket means 68 extends between shroud 70 and second insert 42 to resist the intrusion of liquid metal into the interface therebetween.

In operation, liquid metal flows through on/off valve 10 when opening 30 is aligned with opening 24. The on/off valve 10 is used to stop the flow of liquid metal by moving slider plate 26 such that opening 30 is not aligned with opening 24, thereby blocking the flow of liquid metal. The flow may be stopped for an extended period because the inductive heating of the metal and slider plate 26 caused by the electromagnetic field generated by EMV 8 will keep the metal in a liquid state. If EMV 8 is de-energized, the metal in nozzle 4 and the upper portion of opening 24 may freeze into a column. However, the frozen column of metal may be remelted by re-energizing EMV 8, thereby causing inductive heating of the metal and slider plate 26. Likewise, if liquid metal intrudes into the interfaces between slider plate 26 and either or both of inserts 40, 42, the metal will remain liquid due to the inductive heating of slider plate 26. Accordingly, the intrusion of liquid metal into those interfaces will not adversely affect the operation of on/off valve 10 by locking slider plate 26 into a fixed position. If the metal which has intruded into the interfaces between slider plate 26 and inserts 40, 42 is allowed to freeze, due to the de-energization of EMV 8, the inductive heating of slider plate 26 when EMV 8 is re-energized will melt the frozen metal thereby freeing slider plate 26 to move. This feature eliminates the need to keep the slider plate in constant vibratory motion to prevent it from becoming locked into place by freezing metal and, thus, eliminates the need for a complex activator mechanism for slider plate 26.

As can be seen from the above description, when this device is utilized, access to the discharge end of nozzle 4 is not required to stop or restart the flow of liquid metal therethrough. Accordingly, the likelihood that the nozzle will be damaged due to the application of an oxygen lance is virtually eliminated. In addition, the length of time during which flow may be stopped is not limited with this device because the inductive heating caused by the electromagnetic field generated by EMV 8 will assist in melting any metal that freezes within nozzle 4 or valve combination 2. It will also be appreciated that this invention eliminates the need for a complex actuator mechanism to control the slider plate since the slider plate need not be kept in constant motion to prevent it from being locked into place by freezing metal.

Whereas particular embodiments of this invention have been described for purposes of illustration, it will be evident to those skilled in the art that numerous variations in the details may be made without departing from the invention as described in the appended claims attached hereto.

What is claimed:

1. A valve combination for controlling the flow of liquid metal through an orifice, comprising:

a nozzle constructed of a non-conductive material and having a first generally longitudinal opening therethrough defining an orifice for the flow of liquid metal therethrough, an upstream end of said nozzle being in communication with a source of liquid metal;

an electromagnetic flow control device adjacent to and surrounding said nozzle for controlling the flow of said liquid metal through said nozzle, said electromagnetic flow control device having a coil operable to produce an electromagnetic field within said nozzle and the liquid metal flowing therethrough;

an on/off valve connected to a downstream end of said nozzle; and said on/off valve including a second generally longitudinal opening therethrough and in communication with said first generally longitudinal opening, a slider plate in communication with said second generally longitudinal opening and having at least one opening therethrough, and slide means for moving said slider plate in a plane generally perpendicular to said generally longitudinal openings so as to selectively align said opening through said slider plate with said second generally longitudinal opening, whereby said liquid metal may freely flow through said second generally longitudinal opening when said opening in said slider plate is aligned therewith and said flow of said liquid metal is substantially completely blocked when said opening in said slider plate is not aligned with said second generally longitudinal opening.

2. The valve combination of claim 1, wherein said slider plate is electrically conductive and is positioned sufficiently close to said electromagnetic flow control device so as to be inductively heated thereby.

3. The valve combination of claim 2, wherein said on/off valve includes a first non-conductive insert in communication with said downstream end of said nozzle and having an opening therethrough defining a portion of said second generally longitudinal opening;

a downstream end of said first insert in surface-to-surface communication with an upstream surface of said slider plate;

a second non-conductive insert having an upstream end in surface-to-surface communication with a downstream surface of said slider plate and having an opening therethrough defining a portion of said second generally longitudinal opening; and mounting means for maintaining said first insert in communication with said nozzle, said mounting means including compression means for compressively maintaining said first insert, said slider plate and said second insert in surface-to-surface communication.

4. The valve combination of claim 3, wherein said compression means includes a locking plate surrounding and in communication with said first insert and said slider plate, a collector nozzle in communication with and surrounding said second insert, and a plurality of fastener means for connecting said collector nozzle to said locking plate, said fastener means having spring means thereon for maintaining compressive force between said collector nozzle and said locking plate, whereby said first insert, said slider plate and said second insert are compressively maintained in communication with one another and said first insert is compressively maintained in communication with said nozzle.

5. The valve combination of claim 4, wherein said compression means includes said first insert having a tapered surface in communication with a tapered surface on said locking plate, and said second insert having a tapered surface in communication with a tapered surface on said collector nozzle such that said compressive force is maintained.

6. The valve combination of claim 5, further comprising:

shroud means connected to a downstream end of said on/off valve for defining a conduit for said liquid metal to flow from the valve combination to a casting mold.

7. The valve combination of claim 6, further comprising:

gasket means for resisting flowing liquid metal disposed between said nozzle and said first insert and between said second insert and said collector nozzle and said shroud means.

8. The valve combination of claim 5, wherein said mounting means includes a bayonet mount having a male portion on said locking plate and a female portion on a housing in which said electromagnetic flow device is disposed.

9. The valve combination of claim 8, wherein said slider plate is constructed of graphite.

10. The valve combination of claim 9, wherein said first insert and said second insert are constructed of alumina; and said locking plate and said collector nozzle are constructed of stainless steel.

11. A valve combination for controlling the flow of liquid metal through an orifice, comprising:

a nozzle constructed of non-conductive material and having a first generally longitudinal opening therethrough defining an orifice for the flow of liquid metal therethrough, an upstream end of said nozzle being in communication with a source of liquid metal;

an electromagnetic flow control device adjacent to and surrounding said nozzle for controlling the flow of said liquid metal through said nozzle, said electromagnetic flow control device including an alternating current electromagnetic coil disposed adjacent to said nozzle and surrounding said orifice therein, said coil being operable to produce a magnetic field within said orifice of said nozzle and the liquid metal flowing therethrough and a non-conductive structure disposed along a portion of said coil and occupying an axial portion of said nozzle orifice and leaving an adjacent portion of said nozzle orifice unoccupied by said structure, said structure defining axially extending flow regions and axially extending non-flow regions through said occupied portion of said orifice, said non-flow regions of said structure being positioned circumferentially adjacent to said flow regions, such that said electromagnetic field produces a substantially axially directed pumping force in said nozzle which controls the flow of liquid metal therethrough;

an on/off valve connected to a downstream end of said nozzle; and said on/off valve including a second generally longitudinal opening therethrough in communication with said first generally longitudinal opening, a slider plate in communication with said second generally longitudinal opening and having at least one opening therethrough, and slide means for moving said slider plate in a plane generally perpendicular to said generally longitudinal openings so as to selectively align said opening through said slider plate with said second generally longitudinal opening, whereby said liquid metal may freely flow through said second generally longitudinal opening when said opening in said slider plate is aligned therewith and flow of said liquid metal is blocked substantially completely when said opening in said slider plate is not aligned with said second generally longitudinal opening.

12. The valve combination of claim 11, wherein said slider plate is electrically conductive and is positioned sufficiently close to said electromagnetic flow control device so as to be inductively heated thereby.

13. The valve combination of claim 12, wherein said on/off valve includes a first non-conductive insert in communication with said downstream end of said nozzle and having an opening therethrough defining a portion of said second generally longitudinal opening;

a downstream end of said first insert in surface-to-surface communication with an upstream surface of said slider plate;

a second non-conductive insert having an upstream end in surface-to-surface communication with a downstream surface of said slider plate and having an opening therethrough defining a portion of said second generally longitudinal opening; and mounting means for maintaining said first insert in communication with said nozzle, said mounting means including compression means for compressively maintaining said first insert, said slider plate and said second insert in surface-to-surface communication.

14. The valve combination of claim 13, wherein said compression means includes a locking plate surrounding and in communication with said first insert and said slider plate, a collector nozzle in communication with and surrounding said second insert, and a plurality of fastener means for connecting said collector nozzle to said locking plate, said fastener means having spring means thereon for maintaining compressive force between said collector nozzle and said locking plate, whereby said first insert, said slider plate and said second insert are compressively maintained in communication with one another and said first insert is compressively maintained in communication with said nozzle.

15. The valve combination of claim 14, wherein said compression means includes said first insert having a tapered surface in communication with a tapered surface on said locking plate, and said second insert has a tapered surface in communication with a tapered surface on said collector nozzle such that said compressive force is maintained.

16. The valve combination of claim 15, further comprising:

shroud means connected to a downstream end of said on/off valve for defining a conduit for said liquid metal to flow from the valve combination to a casting mold.

17. The valve combination of claim 16, further comprising:

gasket means for resisting flowing liquid metal disposed between said nozzle and said first insert and between said second insert and said collector nozzle and said shroud means.

18. The valve combination of claim 15, wherein said mounting means includes a bayonet mount having a male portion on said locking plate and a female portion on a housing in which said electromagnetic flow device is disposed.

19. The valve combination of claim 18, wherein said slider plate is constructed of graphite.

20. The valve combination of claim 19, wherein said first insert and said second insert are constructed of alumina; and said locking plate and said collector nozzle are constructed of stainless steel.

* * * * *